United States Patent [19]

Nickerson et al.

[11] 4,186,799

[45] Feb. 5, 1980

[54] SLAB HEADER

[75] Inventors: James H. D. Nickerson; Robert R. Steel, both of St. Catharines, Canada

[73] Assignee: Foster Wheeler Limited, St. Catharines, Canada

[21] Appl. No.: 807,845

[22] Filed: Jun. 20, 1977

Related U.S. Application Data

[60] Division of Ser. No. 603,849, Aug. 11, 1975, Pat. No. 4,117,885, which is a continuation of Ser. No. 510,327, Sep. 30, 1974, abandoned.

[51] Int. Cl.[2] ..... F28F 9/22

[52] U.S. Cl. ..... 165/176; 29/157.4; 122/512; 165/163; 165/174

[58] Field of Search ..... 165/158, 163, 174, 173, 165/175, 176; 29/157.4; 122/32, 34, 365, 511, 512

[56] References Cited

U.S. PATENT DOCUMENTS 3,126,949 3/1964 Boni, Sr. et al. ..... 165/163

3,260,307 7/1966 Dawson ..... 165/176

*Primary Examiner*—Sheldon J. Richter

*Attorney, Agent, or Firm*—Marvin A. Naigur; John E. Wilson

[57] ABSTRACT

A heat exchange vessel has a plurality of tubes disposed therein. A tube sheet section in the vessel has a plurality of ports formed therein for receiving one end of each of said tubes, and at least one channel is formed in said first tube sheet section for communicating with said ports. An additional tube sheet section disposed in said vessel has a plurality of ports formed therein for receiving the other ends of said tubes and at least one channel formed in said additional tube sheet section is provided for communicating with said latter ports. Means is provided for introducing a heat exchange fluid to the channel associated with one of said tube sheet sections for passing through its respective ports through said tubes. Likewise means is provided for collecting the fluid from the channel associated with the other tube sheet section for passing the fluid externally of the vessel.

5 Claims, 11 Drawing Figures

FIG. 3
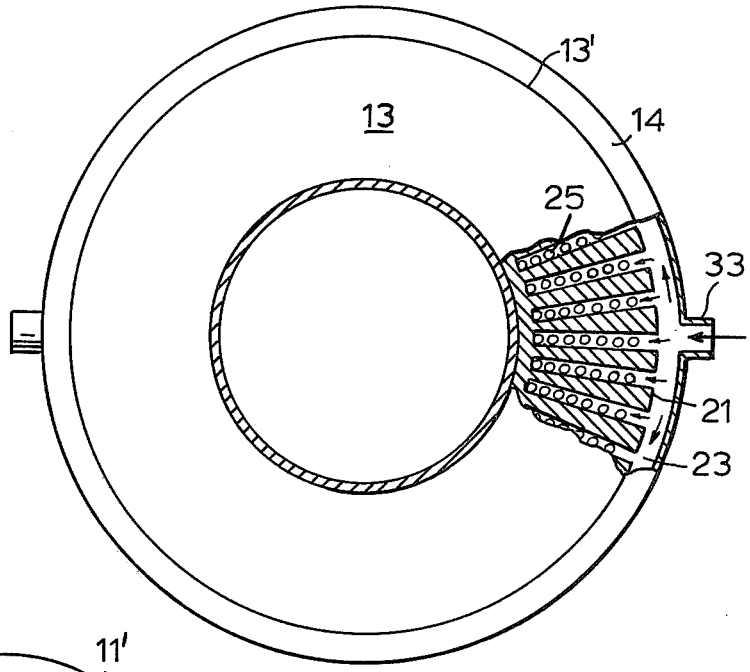
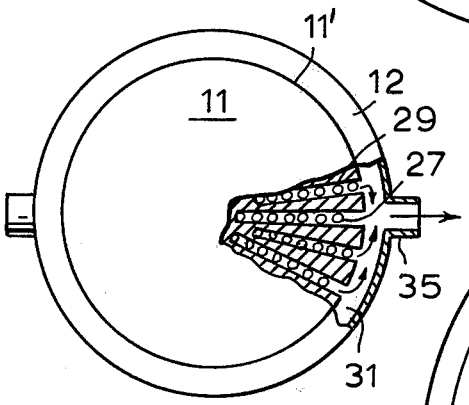
FIG. 4
FIG. 5
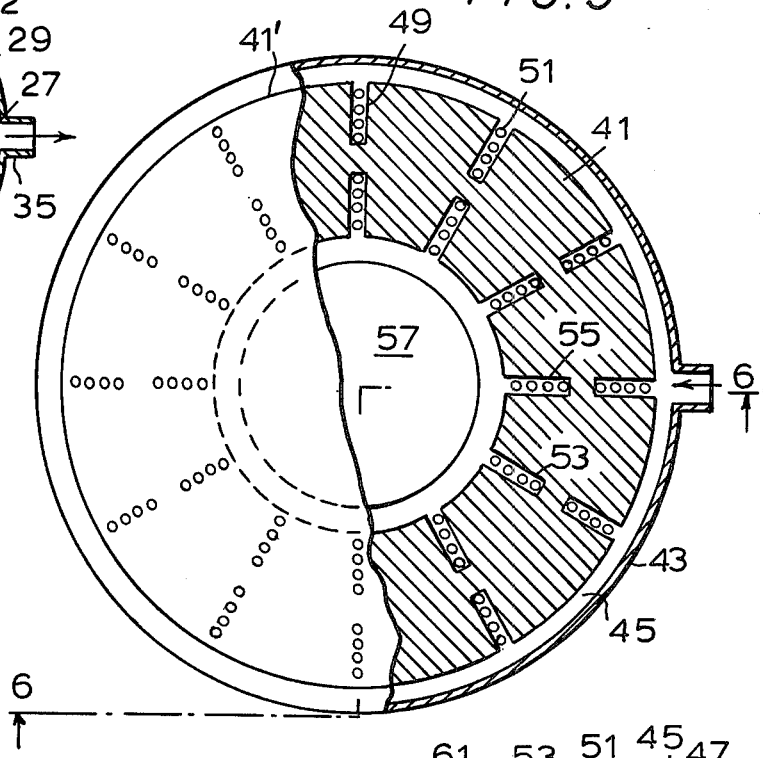
FIG. 6
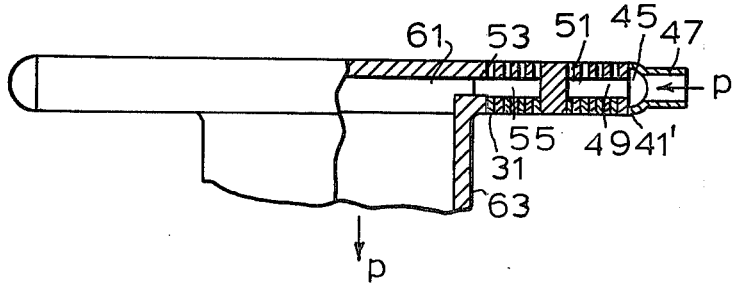

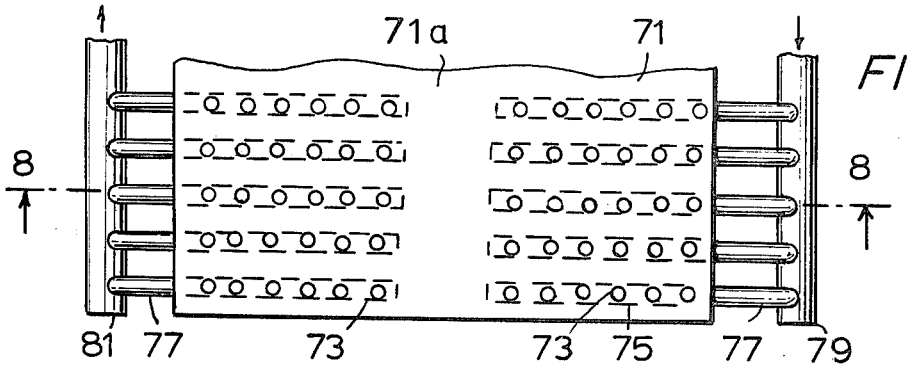
FIG. 7
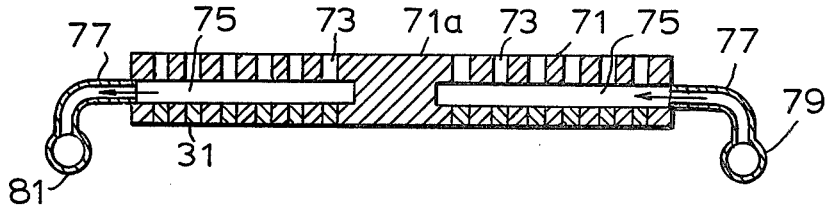
FIG 8
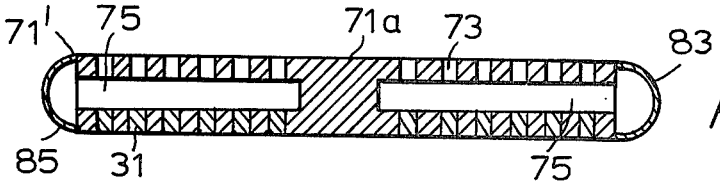
FIG. 9
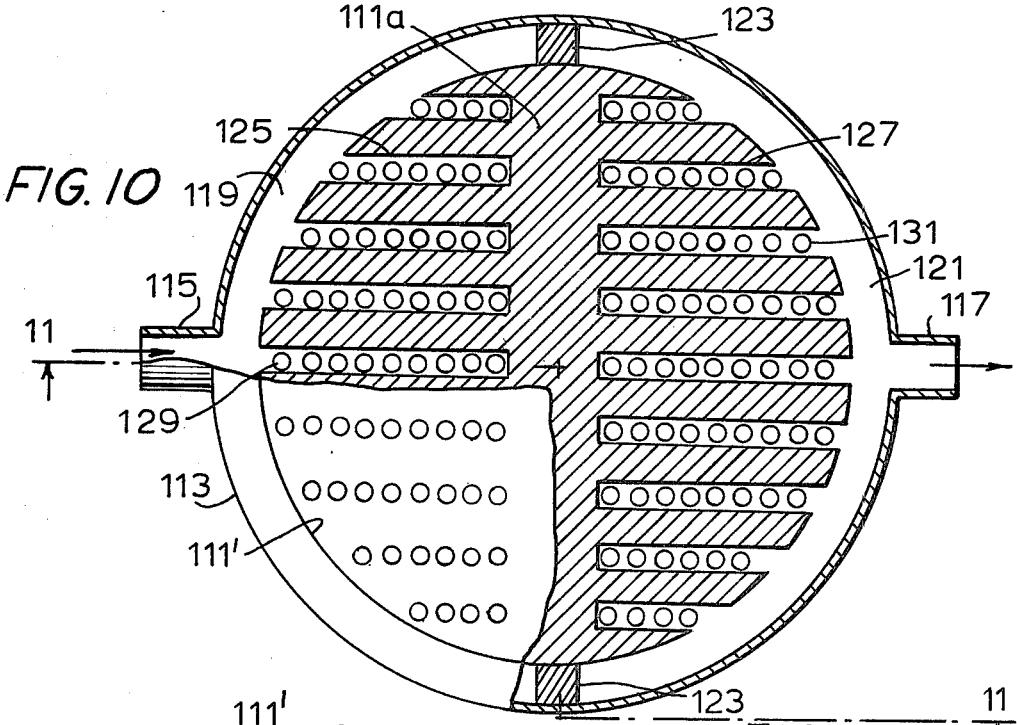
FIG. 10
FIG. 11
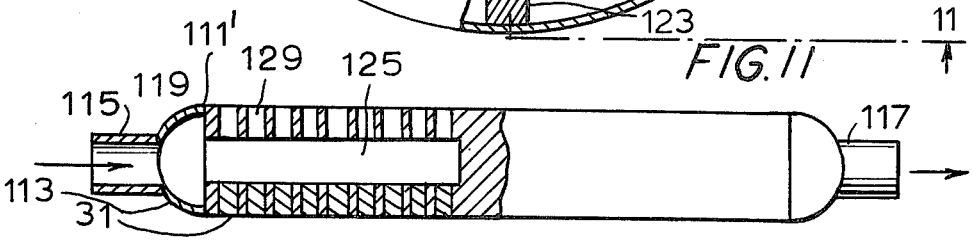

SLAB HEADER

REFERENCE TO RELATED APPLICATION

This is a divisional application of Ser. No. 603,849, filed Aug. 11, 1975, now U.S. Pat. No. 4,117,885, which is a continuation of Ser. No. 510,327, filed Sept. 30, 1974, now abandoned.

BACKGROUND OF THE INVENTION

In such devices as heat exchangers and the like, a plurality of tubes, often arranged in incoming and outgoing tube bundles, is used for providing a flow path for working fluids. Relatively thin tube sheets have been used to fix the location of tube bundles. Pressurized working fluid is introduced through an inlet pipe emptying into an inlet inventory chamber, which fluid then flows through the tubes, wherein indirect heat exchange takes place with a secondary fluid; thereafter the fluid empties into an outlet inventory chamber, and exits through an outlet pipe. Typically, a hemispherical head arrangement has been associated with such heat exchange devices, a characteristic of which is a relatively large inventory chamber for the working fluid. Due to this large chamber, a considerable volume of working fluid is contained in the heat exchange device at any time. The shortcoming of the header arrangement is that working fluid, especially in the case of nuclear heat exchangers, is quite expensive, and therefore, associated material costs are high. For example, heavy water, $D_2O$, one popular working fluid, is now priced at approximately $2,000 per cubic foot.

SUMMARY OF THE INVENTION

Means have been provided through application of the present invention for significant reduction of the inventory chamber volume of the header. By reducing the inventory chamber volume of the header, the working fluid requirement is reduced; accordingly, the associated material cost of working fluid is significantly reduced.

In accordance with the specific arrangement of the present invention, there is provided a heat exchanger including a vessel, having a plurality of tubes disposed therein. A tube sheet section in said vessel has a plurality of ports formed therein for receiving one end of each of said tubes, and at least one channel formed in said first tube sheet section and communicating with said ports. An additional tube sheet section disposed in said vessel has a plurality of ports formed therein for receiving the other ends of said tubes, and at least one channel formed in said additional tube sheet section is provided for communicating with said latter ports. Means is provided for introducing a heat exchange fluid to the channel associated with one of said tube sheet sections for passing through its respective ports and through said tubes. Likewise, means is provided for collecting the fluid from the channel associated with the other tube sheet section for passing the fluid externally of the vessel.

BRIEF DESCRIPTION OF THE DRAWINGS

The above brief description as well as further objects, features, and advantages of the present invention will be more fully appreciated by reference to the following detailed description of presently preferred but nonetheless illustrative embodiments in accordance with the present invention when taken in connection with the accompanying drawings wherein:

FIG. 3 is a plan view, partially in section, of an upper tube sheet utilized in the embodiment of FIG. 2;

FIG. 4 is a plan view, partially in section, of a lower tube sheet utilized in the embodiment of FIG. 2;

FIG. 5 is a view similar to FIGS. 3 and 4 but depicting an alternative embodiment of a tube sheet utilized in the arrangement of the present invention;

FIG. 6 is a sectional view taken along the line 6—6 of FIG. 5;

FIG. 7 is a view similar to FIGS. 3 and 4, but depicting an alternative embodiment of a tube sheet utilized in the arrangement of the present invention;

FIG. 8 is a sectional view taken along the line 8—8 of FIG. 7;

FIG. 9 is a view similar to FIG. 8 but depicting an alternative embodiment of the tube sheet utilized in the arrangement of the present invention;

FIG. 10 is a view similar to FIGS. 3 and 4 but depicting an alternative embodiment of the tube sheet utilized in the arrangement of the present invention; and FIG. 11 is a sectional view taken along the line 11—11 of FIG. 10.

DESCRIPTION OF THE PREFERRED EMBODIMENT

Figure 1:
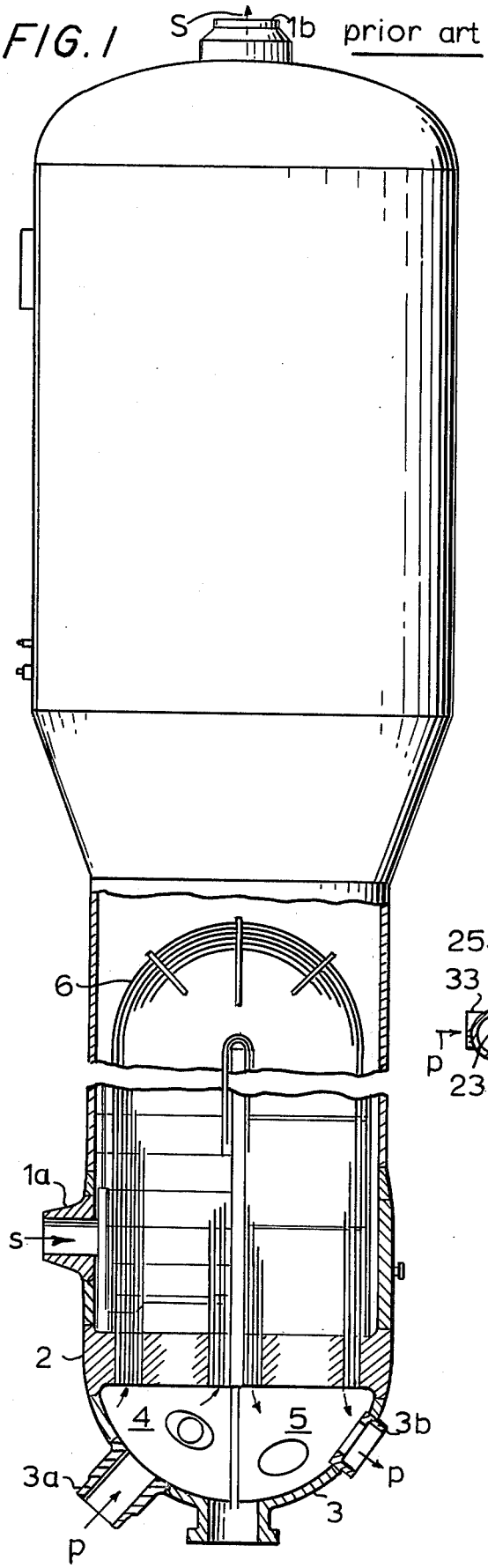
FIG. 1 prior art
FIG. 1 is an elevational view, partially in section of a representative example of the prior art.

In FIG. 1 there is illustrated a shell-type heat exchanger of the prior art, wherein a primary working fluid experiences indirect heat exchange with a secondary working fluid. The heat exchanger consists of a vessel 1 having a tube sheet 2 disposed at its lower end portion and a header 3 attached to the tube sheet. The header 3 has an inlet **3*a*, an outlet 3*b*, and defines an incoming working fluid chamber 4 and an outgoing inventory chamber 5. A plurality of substantially U-shaped tubes 6 have their respective end portions mounted in the tube sheet 2 for passing fluid from the chamber 4 to the chamber 5. Primary working fluid is indicated by arrows P. The vessel 1 has an inlet 1*a* and an outlet 1*b* for secondary working fluid indicated by arrows S. It is understood that secondary fluid is passed in a heat exchange relation to the primary working fluid passing through the tubes 6** to raise the temperature of the secondary fluid to the extent that it is typically converted from a liquid to a gas.

In the above arrangement, the role of the tube sheet 2 is basically to fix the location of the tubes 6. The header 3 is of hemispherical configuration with a radius of nearly three times the width of the tube sheet. The inventory volume of the header 3 is therefore relatively large.

Figure 2:
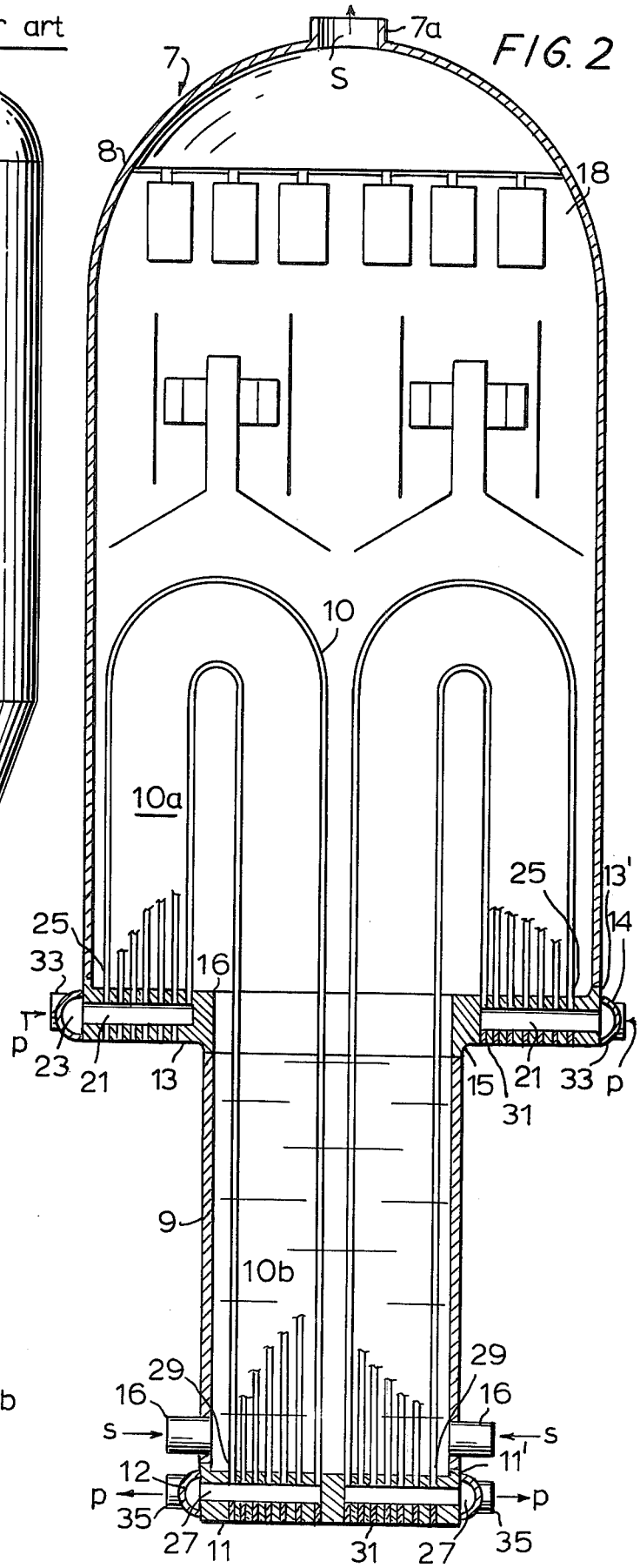
FIG. 2 is a vertical sectional view of an embodiment of the heat exchanger of the present invention.

The above prior art arrangement is to be compared with that of the present invention, an embodiment of which is shown in FIGS. 2-4. In particular, a vessel 7 is formed by an upper shell portion 8 and a lower shell portion 9 of a smaller diameter than the upper shell portion, with the two shell portions being connected in a manner to be described in detail later. A plurality of tubes 10 are disposed within the vessel 7 and have portions extending in both shell portions 8 and 9. The vessel 7 has one or more inlets 16 for a secondary working fluid which is passed in heat exchange relation with primary fluid passing through tubes 10. Above the tubes 10 is a drier and separator section 18, through which the secondary working fluid, such as water, passes, and wherein steam, formed as a result of the heat exchange process, is dried and separated in a conventional manner. The dry steam passes from the vessel 7 through an outlet 7*a*, and the condensate returns to the lower section of the vessel.

A first centrally positioned tube sheet 11 is attached to the lower end of the shell 9. The tube sheet 11 is formed from a relatively thick cylindrical slab. A shell 12 is attached about the periphery 11*a* of the tube sheet 11. A second tube sheet 12 is attached between upper and lower shell portions 8 and 9 at corresponding end portions of the shells 8 and 9. The second tube sheet is formed from a relatively thick annular slab. Tube sheet 13 has a shell 14 attached about its periphery 13*a*. The shells 12 and 14 resemble a section of a torus, generated by a cylindrical axis cutting axially across the torus, and are attached to the tube sheets 11 and 13, respectively, at seams 11′ and 13′ corresponding to the outer peripheral edges.

The shell 9 extends from an inner peripheral edge 16 of the tube sheet 13 to the outer peripheral edge 11′ of the tube sheet 11. The tubes 10 are fabricated with shorter and longer leg portions 10*a* and 10*b* respectively. The shorter legs of the tubes 10 are attached to the tube sheet 13 and the longer legs 10*b* of the tubes are attached to the sheet 11. A gradual thermal gradient, increasing upwardly and outwardly characterizes the chamber defined within the shell 9.

As better shown in FIG. 3, incoming fluid channels 21 are located within the torroidal tube sheet 13 and communicate with an inlet chamber 23, defined by the shell 14 and the outer edge 13′ of the tube sheet 13. Fluid channels 21 communicate with tube ports 25. As better shown in FIG. 4, outlet channels 27 communicate with outlet tube ports 29, and outlet annular chamber 31 defined by the shell 12 and the outer edge 11′ of the tube sheet 11. Inlet means 33 are affixed to the shell 14, while outlet means 35 are similarly affixed to the shell 12.

In operation, the flow path of primary working fluid P is as follows: primary working fluid enters the vessel through inlet means 33, fills the annular chamber 23, flows into inlet channels 21, up through tube ports 25, through tubes 10, into tube ports 29, then to outlet channels 27, into annular chamber 31, and exits through outlet means 35.

In the illustrations of previously described embodiments, as well as in those described hereafter, arrows P and S have been used to indicate respective flow directions of primary and secondary fluids. These are intended merely for illustration as are the descriptions of chambers, channels, and ports as inlets and outlets. It is to be understood that fluid may flow in the opposite direction, thereby reversing the function of previously labelled inlet and outlet means.

An alternate embodiment of the tube sheet portion of the heat exchanger of the present invention is shown in FIGS. 5 and 6. In this embodiment a single tube sheet 41 on one level is used and tubes (not shown) have legs of equal length. Tube sheet 41 is formed from an annular slab and has a shell 43 extending around its outer periphery 41′ in a spaced relation thereto to define a chamber 45. Inlet means 47 is affixed to the shell 43 thereby allowing for introduction of primary working fluid to the chamber 45. Inlet channels 49 are located within the tube sheet 41, extending radially inward from the outer periphery 41′ of the tube sheet 41. The inlet channels 49 communicate with inlet tube ports 51, wherein ends of the heat exchanger tubes are situated. The outlet ends of the tubes are located in corresponding outlet tube ports 53, generally radially aligned with the associated inlet tube ports 51. Outgoing fluid channels 55 communicate with outgoing tube ports 53 and empty into an outgoing fluid chamber 61, defined by a centered counterbore. Outlet means 63 is affixed about the periphery of the outlet chamber 61 to allow for removal of primary working fluid. In this embodiment as well as in the following embodiments, the tubes and the vessel portion of the heat exchanger are not shown for the convenience of presentation.

In the embodiment of FIGS. 7 and 8, a tube sheet 71 is provided, which is formed from a rectangular slab, and has a plurality of tube ports 73 disposed in a plurality of spaced parallel rows extending to both sides of a solid portion 71*a* of the tube sheet, to form two separate tube sheet sections. A plurality of spaced parallel rows of channels 75 are disposed in the tube sheet 71 in communication with the rows of tube ports 73. A plurality of feeder pipes 77 connect headers 79 to the channels 75. It should be understood that headers 79 and 81 could be inlet or outlet channels depending on fluid flow. Accordingly, by defining header 79 as inlet and header 81 as outlet, fluid from the inlet header 79 is introduced to the feeder pipes 77 filing channels 75 tubes (not shown) and tube ports 73 extending to the right of the solid tube sheet portion 71*a*, as viewed in FIG. 7. After flow through the tubes, the fluid passes into and through the ports 73 extending to the left of the portion 71*a* where it flows through the channels 75 and the pipes 77 for collection in the outlet header 81.

Although a rectangular tube sheet is shown in the embodiment of FIGS. 7 and 8, it is to be understood that the tube sheet may be circular, and have feeder pipes and inlet and outlet headers arranged to conform with such a tube sheet configuration. In this connection the headers 79 and 81 and feeder pipes 77 could be adapted for use in each of the embodiments shown.

FIG. 9 illustrates an alternative arrangement for the supply and removal of fluid for the embodiments of FIGS. 7 and 8. In the arrangement of FIG. 9, pipes 77 and headers 79 and 81 are eliminated and semi-cylindrical sections 83 and 85 are affixed to the tube sheet 71 at each of its respective edges 71′. Primary working fluid would enter through the inlet section 83, and leave through the exit section 85.

FIGS. 10 and 11 portray an embodiment of the invention wherein tube bundles are so arranged that inlet and outlet tube ports 131 and corresponding inlet and outlet channels 127 are segregated in a back-to-back "D" configuration. The header includes a tube sheet 111, with a torroidal section 113 attached about its periphery 111′, having inlet and outlet means 115 and 117, respectively, affixed to the section 113. The inlet means 115 communicates with an annular inlet chamber 119, and similarly the outlet means 117 communicates with an annular outlet chamber 121. Webs 123 are attached to the peripheral edge 111′ of tube sheet 113 in alignment with solid tube sheet portion 111*a* and inner surfaces 113*a* of the torroidal section 113. Each of the chambers 119 and 121 are defined by the peripheral edge 111′ of the tube sheet 111, the torroidal section 113 and webs 123.

Inlet and outlet channels 125 and 127, resectively, extend inwardly, and parallel to each other, from the tube sheet peripheral edge 111′. The channels 125 and 127 communicate with corresponding inlet and outlet tube ports 129 and 131, respectively, and with the corresponding inlet and outlet annular chambers 119 and 121, respectively.

In each embodiment it should be noted that the tube ports may extend completely through the tube sheet. In each case the portion of each tube port below the channels formed in the tube sheet is provided with plugs 31 to prevent escape of working fluid. The plugs 31 are removable, thereby allowing for access to tube ends for eddy current testing, tube by-pass, repair, and the like.

It is thus seen that, according to the present invention, the inventory chamber volume of the header arrangement is significantly reduced when compared to the prior art arrangements, since the diameter of the tube channels are only a fraction of the tube sheet width. The channels when combined with the annular chamber defined by the annular shell comprise the inventory chamber for the fluid. The dimensions of the tube sheet channels and the annular shell are such that the volume of fluid emptying into the inventory chamber may escape through exit means without impairing the fluid flow rate through the tubework of the vessel. Therefore, according to the arrangement of the present invention, the volume of primary working fluid not experiencing heat exchange with a secondary fluid is kept to a minimum while the primary working fluid is routed into and out of the vessel.

While there has been described what at present are considered to be the preferred embodiment of the present invention, it is to be understood that various changes and modifications may be made herein which would be obvious to one skilled in the art and it is intended in the appended claims to cover such modifications as fall within the true spirit and scope of the present invention.

What is claimed is:

1. A heat exchanger comprising:

a vessel;

a first tube sheet axially disposed within said vessel and having a first channel extending into said tube sheet from a periphery thereof;

a second tube sheet coaxial with said first tube sheet and having a channel extending into said tube sheet from a periphery thereof;

a plurality of tubes perpendicular to said channels, each of said tubes having a first leg connected to said first tube sheet for communication with said channel extending into said first tube sheet and a second leg connected to said second tube sheet for communication with said channel extending into said second tube sheet, said tube legs being received in said channels along the lengths of said channels;

a first peripheral chamber communicating with said channel extending into said first tube sheet;

a second peripheral chamber communicating with said channel extending into said second tube sheet;

means for introducing a heat exchange fluid into one of said chambers, and means for removing said heat exchange fluid from the other of said chambers.

2. The heat exchanger of claim 1 wherein said first chamber comprises an annular shell extending around the outer periphery of said first tube sheet, and said second chamber comprises an annular shell extending around the outer periphery of said second tube sheet.

3. The heat exchanger of claim 1 wherein said vessel is formed by an outer shell having one end closed in and one end open, and an inner shell having one open end extending proximate to the open end of said outer shell and another open end disposed externally of said outer shell.

4. The heat exchanger of claim 3 wherein said channel extending into said first tube sheet is one of a plurality of channels extending into said first tube sheet and wherein said channel extending into said second tube sheet is one of a plurality of channels extending into said second tube sheet.

5. The heat exchanger of claim 4 wherein said plurality of channels extending into said first and second tube sheets respectively extend in a radial direction with respect to said respective tube sheets.

* * * * *